US011801970B2

(12) United States Patent
Jian et al.

(10) Patent No.: US 11,801,970 B2
(45) Date of Patent: Oct. 31, 2023

(54) FOLDABLE CONTAINER

(71) Applicant: SHANGHAI HONGYAN RETURNABLE TRANSIT PACKAGINGS CO., LTD., Shanghai (CN)

(72) Inventors: Yuanli Jian, Shanghai (CN); Sendi Tong, Shanghai (CN)

(73) Assignee: SHANGHAI HONGYAN RETURNABLE TRANSIT PACKAGINGS CO., LTD., Shanghai (CN)

( * ) Notice: Subject to any disclaimer, the term of this patent is extended or adjusted under 35 U.S.C. 154(b) by 1299 days.

(21) Appl. No.: 16/095,240

(22) PCT Filed: Apr. 18, 2017

(86) PCT No.: PCT/CN2017/080962

§ 371 (c)(1),
(2) Date: Oct. 19, 2018

(87) PCT Pub. No.: WO2017/181944

PCT Pub. Date: Oct. 26, 2017

(65) Prior Publication Data

US 2019/0084720 A1 Mar. 21, 2019

(30) Foreign Application Priority Data

Apr. 19, 2016 (CN) ..... 201610244020.2

(51) Int. Cl.
*B65D 19/18* (2006.01)
*B65D 19/06* (2006.01)

(52) U.S. Cl.
CPC ..... *B65D 19/18* (2013.01); *B65D 19/06* (2013.01); *B65D 2519/009* (2013.01);
(Continued)

(58) Field of Classification Search
CPC ..... B65D 2519/00452; B65D 2519/00129; B65D 2519/009; B65D 2519/006;
(Continued)

(56) References Cited

U.S. PATENT DOCUMENTS 2,890,809 A * 6/1959 Poley ..... B65D 9/18 217/65
3,085,706 A * 4/1963 Rawle ..... B65D 19/16 217/43 A (Continued)

FOREIGN PATENT DOCUMENTS

AU 7817691 A 8/1991
CN 102514795 A * 6/2012 ..... B65D 11/22

(Continued)

OTHER PUBLICATIONS

International Search Report and Written Opinion, International Patent Application No. PCT/CN2017/080962, dated Jun. 22, 2017, with English translation (16 pages).

(Continued)

*Primary Examiner* — Mollie Impink
(74) *Attorney, Agent, or Firm* — Hamre, Schumann, Mueller & Larson, P.C.

(57) ABSTRACT

Disclosed is a foldable container. The container comprises a base (5) and two pairs of side plates (1, 2, 3, 4). The side plates are connected to the base in a manner such that the side plates can be folded relative to the base. Each of the side plates is provided with at least one first reinforcement member (6). Where the side plates are in an upright state, the first reinforcement members of the adjacent side plates are mutually connected so as to form an annular integral body. By means of the structure of the reinforcement member, the strength of the side plates of the foldable container is improved, and the defect where the side plates turn white, and even bulge, deform and fail when the foldable container bears a heavy load is overcome.

18 Claims, 18 Drawing Sheets

(52) U.S. Cl.
CPC ..... *B65D 2519/00034* (2013.01); *B65D 2519/00069* (2013.01); *B65D 2519/00129* (2013.01); *B65D 2519/00174* (2013.01); *B65D 2519/00338* (2013.01); *B65D 2519/00422* (2013.01); *B65D 2519/00452* (2013.01); *B65D 2519/00502* (2013.01); *B65D 2519/00527* (2013.01); *B65D 2519/00587* (2013.01); *B65D 2519/00611* (2013.01); *B65D 2519/00646* (2013.01)

(58) Field of Classification Search
CPC ..... B65D 2519/00527; B65D 2519/00512; B65D 2519/00422; B65D 2519/00174; B65D 11/28; B65D 11/1833; B65D 11/22; B65D 11/16
See application file for complete search history.

(56) References Cited

U.S. PATENT DOCUMENTS

| | | | | |
|---|---|---|---|---|
| 4,809,851 | A | 3/1989 | Oestreich et al. | |
| 5,386,919 | A | 2/1995 | Long | |
| 5,799,812 | A | 9/1998 | Mansouri | |
| 2003/0102309 | A1 * | 6/2003 | Hartwall ..... | B65D 77/061 220/6 |

FOREIGN PATENT DOCUMENTS

| | | | | |
|---|---|---|---|---|
| CN | 202429441 | U | 9/2012 | |
| CN | 203359246 | U | 12/2013 | |
| CN | 204473370 | U | 7/2015 | |
| CN | 105480520 | A | 4/2016 | |
| CN | 105819064 | A | 8/2016 | |
| FR | 2624831 | A1 | 6/1989 | |
| JP | S63503220 | A | 11/1988 | |
| JP | 2005059907 | A | 3/2005 | |
| JP | 2012224345 | A | 11/2012 | |
| WO | 0147780 | A1 | 7/2001 | |
| WO | WO-2013047706 | A1 * | 4/2013 | ..... B65D 19/18 |

OTHER PUBLICATIONS

Office Action issued in Chinese Application No. 201610244020.2, dated Jun. 23, 2017, with English translation.
Office Action issued in Chinese Application No. 201610244020.2, dated Feb. 24, 2018, with English translation.
The extended European search report issued in European Application No. 17785428.8, dated Oct. 10, 2019.
Examination Report issued in Australian Application No. 2017254033, dated Feb. 5, 2019.
Office Action issued in Japanese Application No. 2018-554720, dated Sep. 10, 2019, with English translation.

* cited by examiner

FOLDABLE CONTAINER

FIELD OF THE INVENTION

The present invention relates to a foldable container, and in particular to side panels of the container.

BACKGROUND OF THE INVENTION

The large-sized foldable container used in modern times are mainly made of metal materials and plastic materials. The plastic foldable containers that are safer for goods are usually used in the field of medical, chemical, food, etc. If the cargo carried in the box is fluid or semi-fluid, the cargo will generate a large lateral pressure on the side panels, at this time, the plastic side panels will need metal pipes built in for auxiliary reinforcement. At present, the bending resistance of the side panels is enhanced by using a built-in aluminum pipe or a steel pipe (taking steel pipes as an example below), which can solve the problem of insufficient bending performance of the plastic side panels under certain circumstances.

However, at present, the steel pipes built in the side panels on the market cannot reach the maximum width or height of the side panels regardless of being placed horizontally or vertically. There is a certain distance between the either side of side panel and either end of the steel pipe, so when side panel are subjected to a bending force, the bending extent of the side panel is the deformation of the steel pipe itself plus the deformation of the steel pipe region of the side panel. That is, due to the shape or manufacturing process of the side panel itself, traditional steel pipe reinforcement tends to have limited effect. Particularly, when the side panel is greatly deformed, the both ends of the steel pipe will exert a reaction force on the plastic side panel by the force transmission of the fixed fulcrum, therefore, when the side panels of the built-in steel pipe are subjected to heavy bending deformation, the position of the side panels at the both ends of the steel pipe will obviously protrude or even turn white, which brings certain hidden dangers to the service life of the side panels and the safety of the cabinet.

In addition, certain specific goods such as pharmaceuticals, chemicals, foods, will have restrictions on storage temperature, such as low temperature of minus 20 degrees or high temperature of 60 degrees, at this time, the size of the plastic box will vary greatly due to the thermal expansion and contraction characteristics, this requires larger reserved distance between the ends of the steel pipe and the ends of the side panels. At the same time, the characteristics of low-temperature embrittlement and high-temperature softening of plastics also require that the reaction force of both ends of the steel pipe on the side panels should be as small as possible.

SUMMARY OF THE INVENTION

The object of the present invention is to solve the problem of insufficient strength of the existing side panels, and to solve the defect that the side panels turn white or even a bulge deformation failure when the container bears heavy load upon folding.

To achieve the above object, the present invention provides a foldable container, comprising a base and two pairs of side panels, the side panels being coupled to the base in a foldable manner relative to the base, wherein each side panels are provided with at least one first reinforcement member, which in the upright state of the side panels mutually connected to the corresponding first reinforcement members in the adjacent side panels.

In a preferred embodiment, when the side panels are in the upright state, the corresponding first reinforcement members of the adjacent side panels of the two pairs of side panels are connected to each other to form a ring-shaped integral body.

In another preferred embodiment, the first reinforcement member is disposed at a middle portion of the side panel. The middle part herein means the side portion which occupies about one third of the side plate in the middle in the height direction.

In another preferred embodiment, the first reinforcement member is parallel to the base.

In another embodiment, the first reinforcement member forms an angle with the base.

In another embodiment, the side panel comprises an inner panel and an outer panel which are fixedly coupled to each other, and the first reinforcement member is disposed between the inner panel and the outer panel.

In a preferred embodiment, the side panels are formed by welding the inner panel and the outer panel together In a preferred embodiment, the side of the inner panel and/or the outer panel on which the first reinforcement member is placed is provided with ribs.

In another embodiment, one end of the first reinforcement member of one of the two adjacent side panels is provided with a first connecting structure, and the corresponding end of the first reinforcement member of the other of the two adjacent side panels is provided with a second connection structure, when the side panels are in an upright state of the side panels, the first connection structure and the second connection structure are connected to each other.

In a preferred embodiment, the first connection structure and the first reinforcement member are separate members and are joined together by fasteners; and/or the second connection structure and the second reinforcement member are separate members and are joined together by fasteners.

In one embodiment, the fastener is a screw or rivet.

In one embodiment, the first connection structure and the second connection structure are exposed on a side of the side panel facing the adjacent side panel.

In a preferred embodiment, the first connection structure is provided with a first interlocking structure, and the second connection structure is provided with a second interlocking structure, wherein when the side panels are in the upright stat, the first interlocking structure and the second interlocking structure are interlocked with each other.

In a preferred embodiment, the first connection structure is provided with a T-shaped interlocking structure and is fixed to the first reinforcement member by a fastener, and the second connection structure is provided with a T-shaped groove, the T-shaped groove and the T-shaped interlocking structure is detachably engaged.

In one embodiment, the second connection structure is provided with an interlocking portion and a connection portion, the interlocking portion is provided with the T-shaped groove, the connection portion is inserted into the first reinforcement member and fixed on the first reinforcement member by the fastener.

In a preferred embodiment, the first connection structure and/or the second connection structure are movably coupled to the first reinforcement member.

In one embodiment, one side panel of the two adjacent side panels comprises a first inner panel and a first outer panel that are fixedly coupled to each other, the first reinforcement member in the side panel comprises a first steel pipe and a dovetail member at both ends of the first steel pipe, a first U-shaped fixing piece and fastener, wherein the long hole is provided on the end of the first steel pipe, and the dovetail member comprises a T-shaped groove and is provided with a first connecting hole, and the first U-shaped fixing piece is provided with a second connecting hole, the first inner panel is provided with a third connecting hole, and the fastener sequentially passes through the second connecting hole, the long hole, the first connecting hole and the third connecting hole and thereby fix the first reinforcement member to the first inner panel; the first outer panel is provided with a groove for receiving the U-shaped fixing piece; and the other side panel of the two adjacent side panels comprises a second inner panel and a second outer panel that are fixedly coupled to each other, and the first reinforcement member in the side panel comprises a second steel pipe and a T-shaped wedge at both ends of the second steel pipe, a second U-shaped fixing piece and fastener, wherein the second steel pipe is provided with an long neck at the end, used for receiving the second U-shaped fixing piece, the T-shaped wedge comprises a T-shaped interlocking portion and a connection portion, the connection portion is provided with a fourth connecting hole and inserted into the second steel pipe, the second U-shaped fixing piece is provided with a fifth connecting hole, and the fastener sequentially passes through the fifth connecting hole and the fourth connecting hole, so as to connect the U-shaped fixing piece and the T-shaped wedge to the second steel pipe, the inner panel is provided with a limiting groove for receiving the second steel pipe and the second U-shaped fixing piece.

In a preferred embodiment, each of the side panels also comprises a second reinforce, and the second reinforcement member is fixedly coupled to the first reinforcement member.

In a preferred embodiment, the second reinforcement member is perpendicular to the base.

In a preferred embodiment, one end of the second reinforcement member extends to the top end of the side panel, and the other end of the second reinforcement member extends to the bottom end of the side panel.

The invention of steel pipe connection structure strengthening the side panel, is used in the foldable container, forming an interconnected frame structure between the side panels, enhancing the strength of the side panels of the foldable container, solving the defect that the foldable container turns white or even bulge deformation failure when the container bears a heavy load. At the same time, it provides good strength support and box protection effect for the side panels in normal temperature environment or hot and cold environment, which improves the strength, safety and service life of the product, and saves logistics and storage costs.

DRAWINGS

DETAILED DESCRIPTION OF THE EMBODIMENTS

Figure 1:
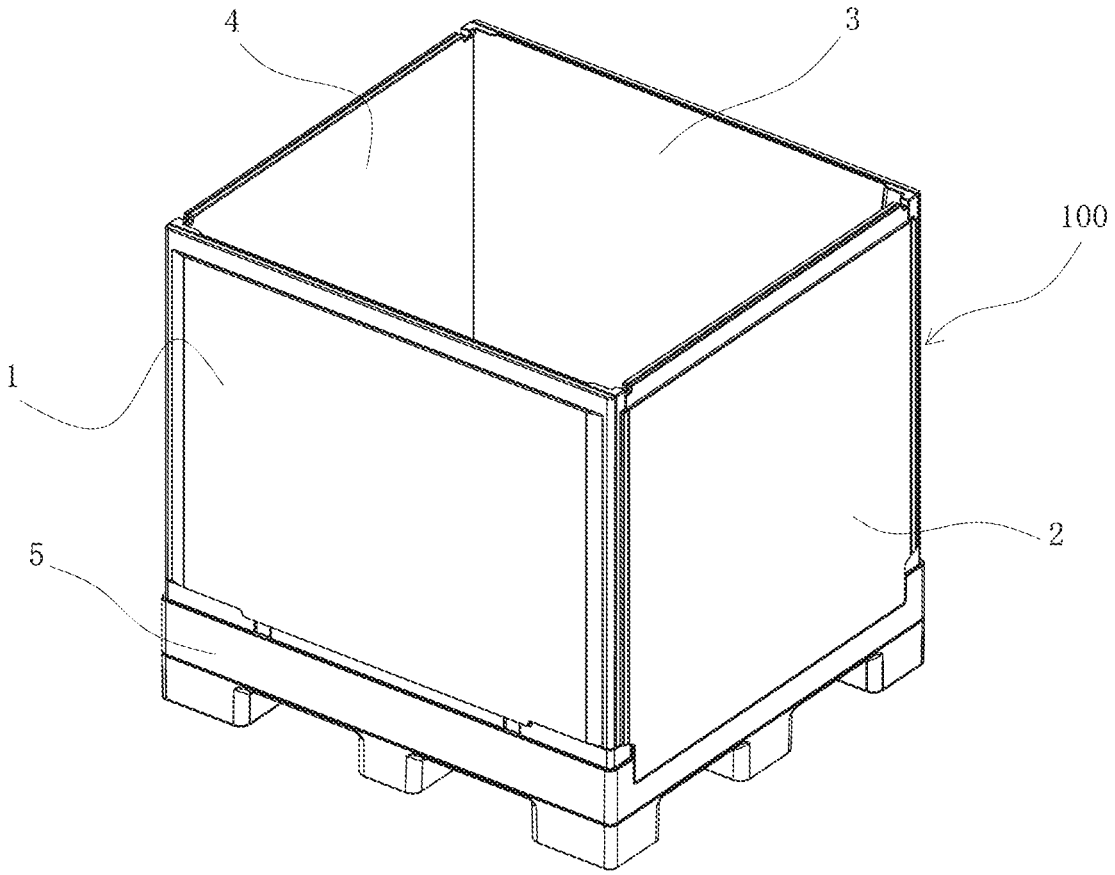
FIG. 1 is a structural schematic view of a container according to a first embodiment of the present invention, wherein the side panels are in an upright state.

The preferred embodiments of the present invention will be described in detail below with reference to the accompanying drawings, in order to more clearly understand the objects, features and advantages of the present invention. It should be understood that the embodiment shown in the drawings is not intended to limit the scope of the invention, but only to illustrate the spirit of the invention.

As shown in FIG. 1, the container 100 includes a first pair of side panels 1 and 3, a second pair of side panels 2 and 4, and a base 5, wherein all the side panels are connected to the base 5 in a foldable manner relative to the base 5. For example, the side panels are connected to the base 5 by hinges. The first pair of side panels may be long side panels, and the second pair of side panels may be side panels shorter than the first pair of side panels. The side panels 1, 2, 3 and 4 are provided with reinforcement members, in the upright state of the side panels, at least some of the reinforcement members of the adjacent side panels are mutually connected to each other (for example, interlocked to each other) to form an integral body, and when the side panels are pushed down, these reinforcement members in the adjacent side panels can be separated from each other. The reinforcement members in the side panels may include transverse reinforcement members and vertical reinforcement members, and vertical reinforcement members connected to the transverse reinforcement members. The transverse reinforcement members in the adjacent side panels may be connected to each other, and the vertical reinforcement members in the adjacent side panels cannot be connected. The transverse reinforcement members in different side panels may be the same or different, and the transverse reinforcement members are also referred to as first reinforcement members or first type of reinforcement members. Similarly, the vertical reinforcement members in different side panels may be the same or different, and the vertical reinforcement members are also referred to as second reinforcement members or second type of reinforcement members. The transverse reinforce or the first reinforcement member herein refers to a reinforcement member that is substantially parallel to the base, and the vertical reinforcement member or the second reinforcement member herein refers to a reinforcement member that is substantially perpendicular to the base. The meaning of substantially parallel herein includes parallel to the base and forming a certain small angle with the base, for example, an angle of less than 30 degrees. Similarly, the meaning of the substantially vertical includes just perpendicular to the base and slight deviation from vertical, such as a deviation of less than 30 degrees. In a preferred embodiment, the first reinforcement member is arranged in the middle part of the side panel. The middle part herein means the side portion which occupies about one third of the side plate in the middle in the height direction.

Figure 2:
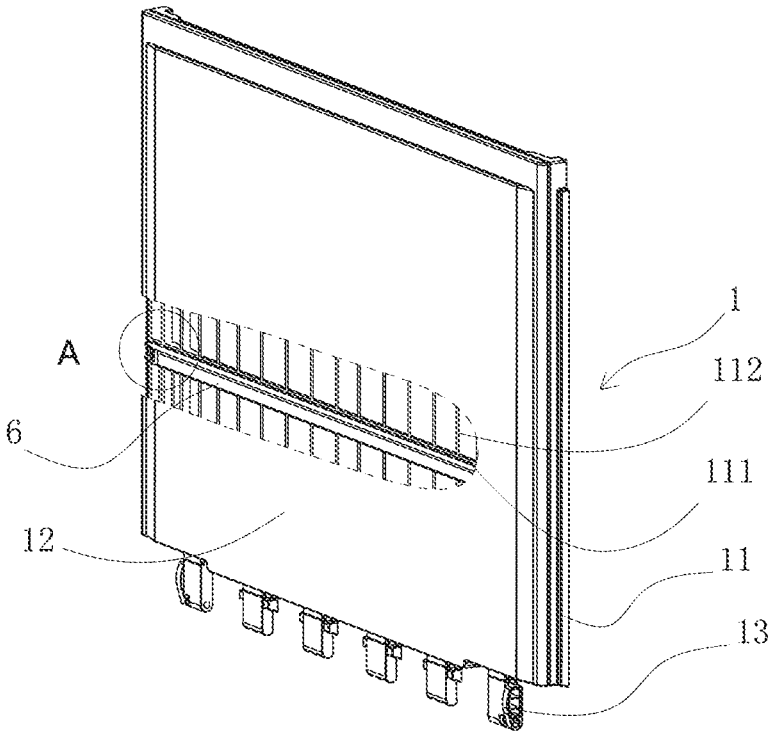
FIG. 2 is a structural schematic view of the side panel of the container of FIG. 1, partially cut away to show the internal reinforcement members.
Figure 2A:
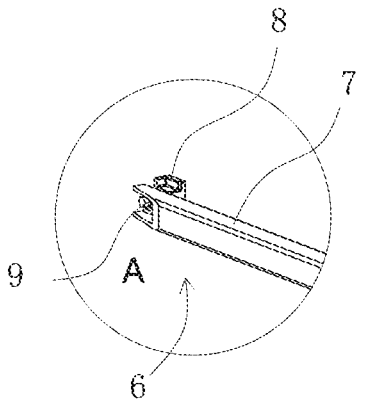
FIG. 2A is an enlarged view of the portion A of FIG. 2.
Figure 2B:
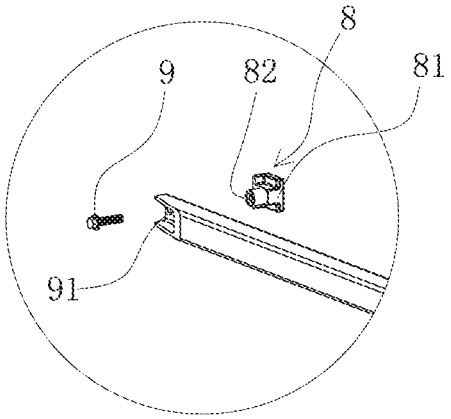
FIG. 2B is an enlarged exploded view of the portion A of FIG. 2.

FIG. 2-2B shows one side panel 1 of two adjacent side panels of a container in accordance with one embodiment of the present invention, for convenience of description, the side panel is referred to as a long side panel 1. As shown, the long side panel 1 includes an inner panel 11 and an outer panel 12, the inner panel 11 and the outer panel 12 are welded to each other to form a long side panel 1. The lower part of the long side panel 1 is provided with a hinge 13, and the long side panel 1 is hinged to the base by a hinge 13, so that the long side panel 1 is foldable relative to the base.

A reinforcement member 6 is disposed between the inner panel 11 and the outer panel 12 of the long side panel, and the reinforcement member 6 is received in a limiting slot 111 of the inner panel 11. The side of the inner panel 11 facing the outer panel is provided with a rib 112 to enhance the strength of the long side panel 1. The reinforcement member 6 comprises a steel pipe 7 and a T-shaped wedge 8 at both ends of the steel pipe 7, T-shaped wedges 8 are connected to both ends of the steel pipe 7 by screws 9. Preferably, the steel pipe 7 is a square pipe, whose cross section is square. The both ends of the steel pipe 7 are provided with mounting holes 91, and the sides of the both ends are partially cut away to expose the inner surface of the steel pipe. The T-shaped wedge 8 is provided with a T-shaped interlocking structure 81 and a mounting hole 82. The T-shaped interlocking structure 81 is used to cooperate with the slot of the reinforcement member on the adjacent side panel, so as to realize the engagement between the two reinforcement members. When the reinforcement member is assembled, the screw 9 sequentially passes through the mounting hole 91 and the mounting hole 82, thereby fixing the T-shaped wedge 8 to the end of the steel pipe. After the reinforcement member 6 is assembled, it is placed between the outer panel 12 and the inner panel 11 of the long side panel 1, and the outer panel 12 is welded to the inner panel 11, the reinforcement member 6 being fixed therein.

Figure 3:
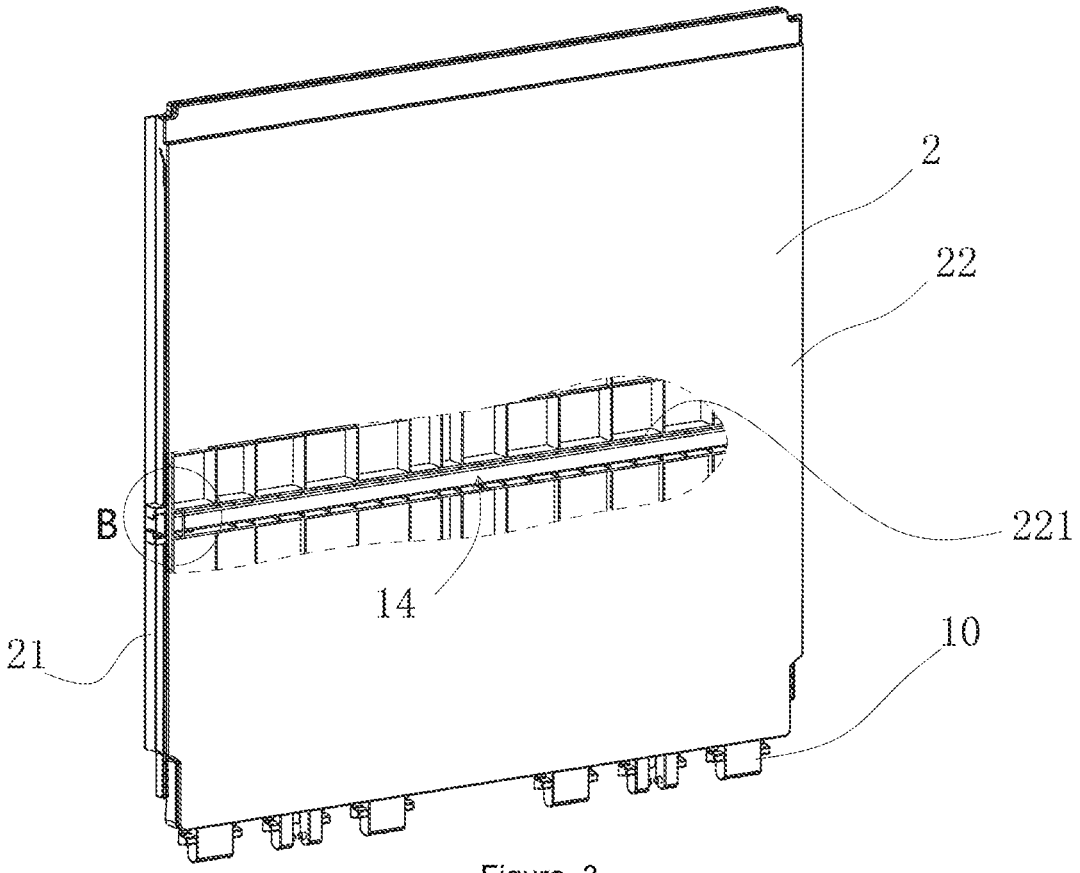
FIG. 3 is a structural schematic view of the side panel adjacent to the side panel of FIG. 2, partially cut away to show the internal reinforcement members.
Figure 3A:
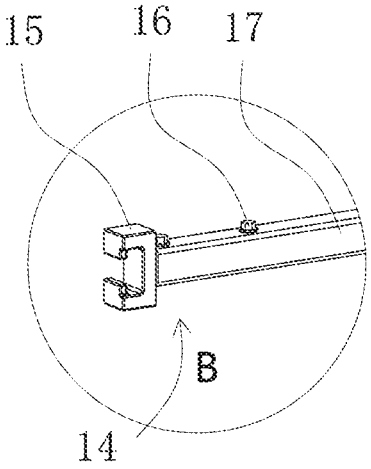
FIG. 3A is an enlarged view of the portion B of FIG. 3.
Figure 3B:
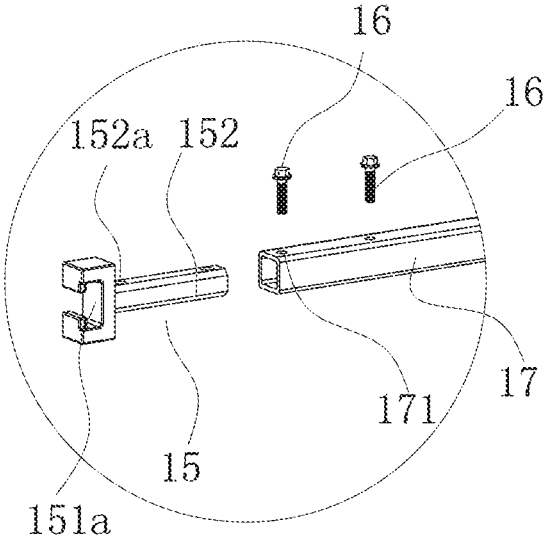
FIG. 3B is an enlarged exploded view of the portion B of FIG. 3.

FIG. 3-3B shows a structural schematic view of the side panel 2 adjacent to the side panel shown in FIG. 2-2B, for convenience of description, the side panel 2 is referred to as a short side panel 2. As shown, the short side panel 2 comprises an inner panel 21 and an outer panel 22, and the inner panel 21 and the outer panel 22 are welded to each other to form a short side panel 2. The lower part of the short side panel 2 is provided with a hinge 10, and the short side panel 2 is hinged to the base 5 by a hinge 10, so that he short side panel 2 is foldable relative to the base 5.

A reinforcement member 14 is further disposed between the inner panel 21 and the outer panel 22 of the short side panel 2, the reinforcement member 14 is received in the limiting slot 221 of the inner panel 21. The side of the inner panel 21 facing the outer panel is provided with a rib to enhance the strength of the short side panel 2. The reinforcement member 14 comprises a steel pipe 17 and the interlocking member 15 located at both ends of the steel pipe 17, which is connected to both ends of the steel pipe 17 by screws 16. Specifically, the interlocking member 15 comprises the interlocking portion 151 and the latch portion 152. The interlocking portion 151 is provided with a slot 151*a*, the slot 151*a* is a T-shaped slot. That is, its cross section is T-shaped to cooperate with the T-shaped wedge, which will be further described below. The pin 152 is provided with a hole 152*a*. The steel pipe 17 is provided with a hole 171. When assembled, the latch portion 152 of the interlocking member 15 is inserted into the steel pipe 17, and the screw 16 passes through the hole 171 and the hole 152*a* in sequence, thereby fixing the steel pipe 17 and the interlocking member 15 together. After the assemble of the reinforcement member 14 is completed, it is placed between the outer panel 22 and the inner panel 21 of the short side panel 2, and the outer panel 22 is welded to the inner panel 21, the reinforcement member 14 being fixed therein.

Figure 4:
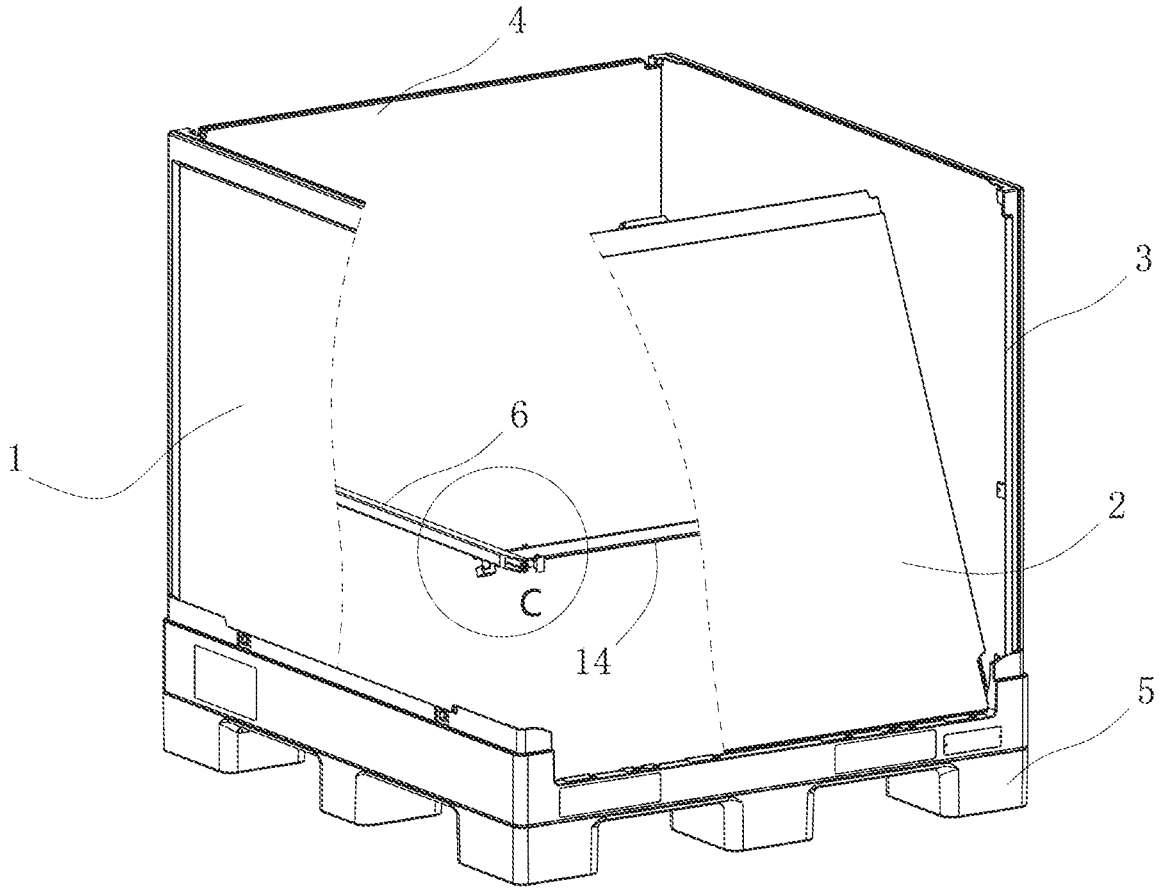
FIG. 4 is a structural schematic view of the container of FIG. 1, showing that when one of the side panels is pushed down, the reinforcement members adjacent to side panels are loosened, wherein part of the side panel structure is cut away to show the internal reinforcement members.
Figure 4A:
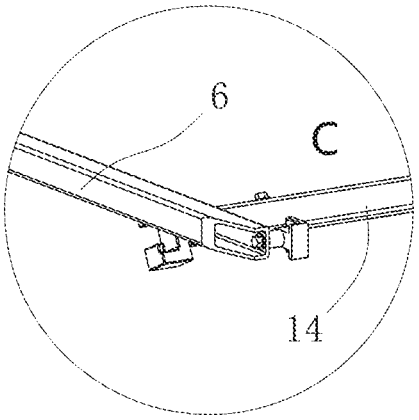
FIG. 4A is an enlarged view of a portion C of FIG. 4.
Figure 5:
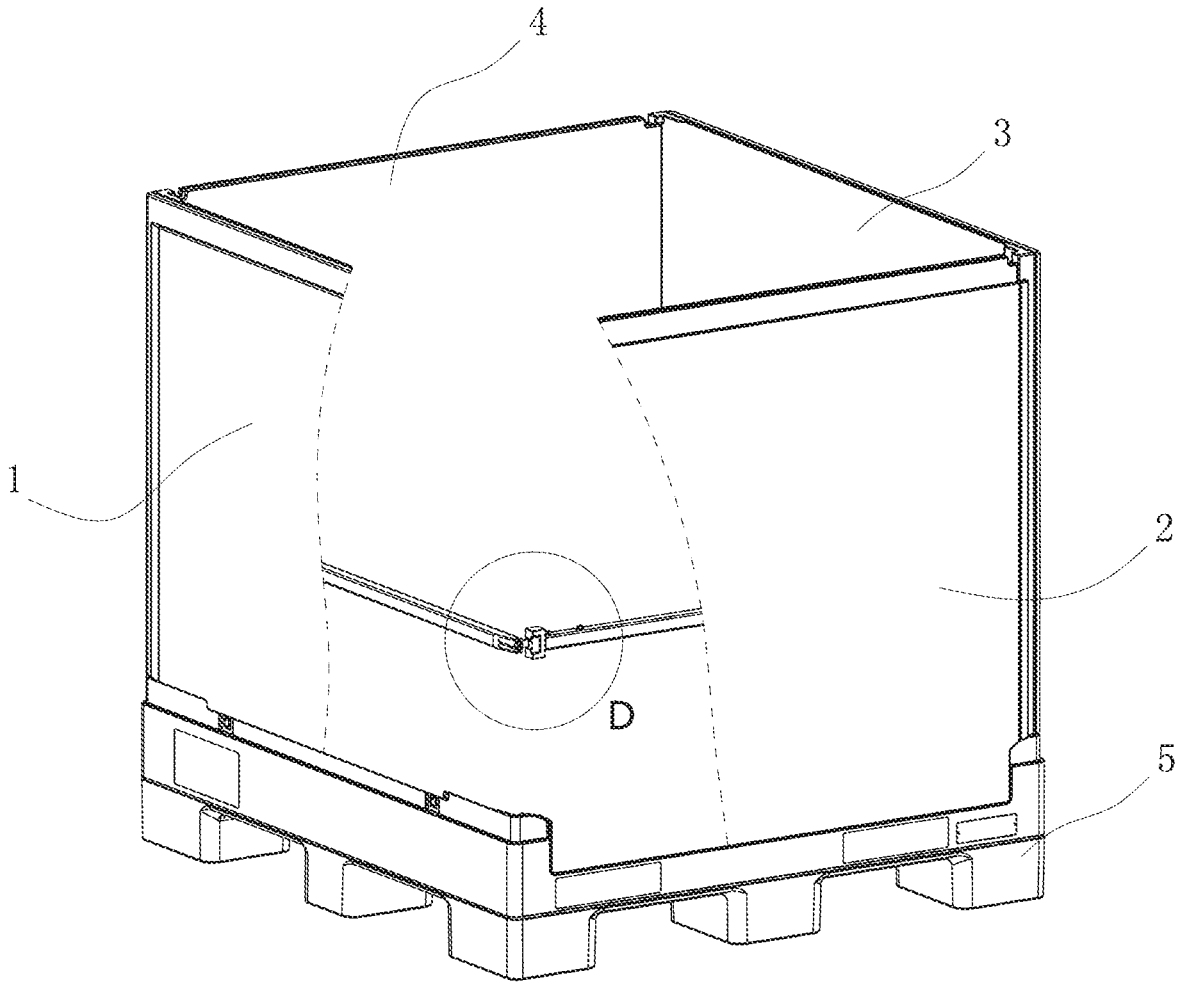
FIG. 5 is a structural schematic view of the container of FIG. 1, showing the state in which the reinforcement members of the adjacent side panels are engaged when the side panels are erected, wherein part of the side panel structure is cut away to show the internal reinforcement members.
Figure 5A:
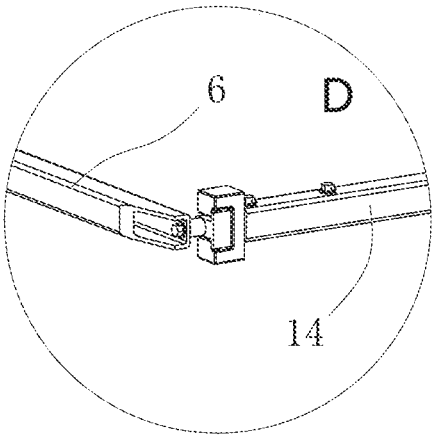
FIG. 5A is an enlarged view of a portion D of FIG. 5.
Figure 6:
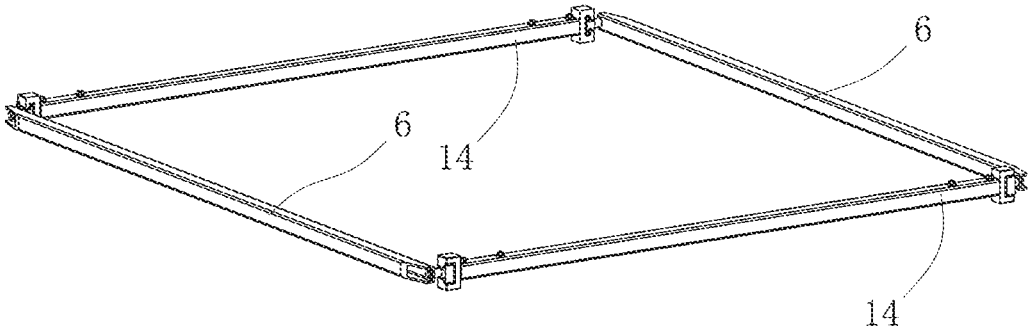
FIG. 6 is a structural schematic view of the reinforcement member in each side panel when the side panels of the container of FIG. 1 are in an upright state.

After the long side panel 1 and the short side panel 2 are assembled and welded, they are installed into the base 5 through hinges, so that the short side panel and the long side panel can be folded by pushing or erected relative to the base. When the side panels are folded (here, the short side panel 2 are taken as an example for explanation), as shown in FIG. 4, when the short side panel 2 is pushed down, the interlocking of the interlocking member 15 and T-shaped wedge 8 is separated apart, at this time, the reinforcement member of the long side panel and the short side panel 2 are separated. When the side panels are in an upright state, as shown in FIGS. 5-6, the interlocking member 15 and the T-shaped wedge 8 are interlocked together, that is, the T-shaped wedge 8 is inserted into the slot 151*a* of the interlocking member 15, and thereby the reinforcement members of the long side panel and the short side panel 2 are connected together. In this way, the corresponding reinforcement members of the two pairs of side panels are mutually connected to each other to form a ring-shaped integral body as shown in FIG. 6.

It should be understood that in the above embodiment, the reinforcement member 6 may also be placed in the short side panel 2, and accordingly, the reinforcement member 14 may also be placed in the long side panel 1. Alternatively, the structure of the reinforcement member of the long side panel 1 and the short side panel 2 may be substantially the same. For example, in this case, the reinforcement members in the short side panel and the long side panel are provided with an interlocking member at one end and a T-shaped wedge at the other end. The reinforcement member 6 and the reinforcement member 14 may be referred to as a first type of reinforcement member or a first reinforcement member or transverse reinforcement member.

Figure 7:
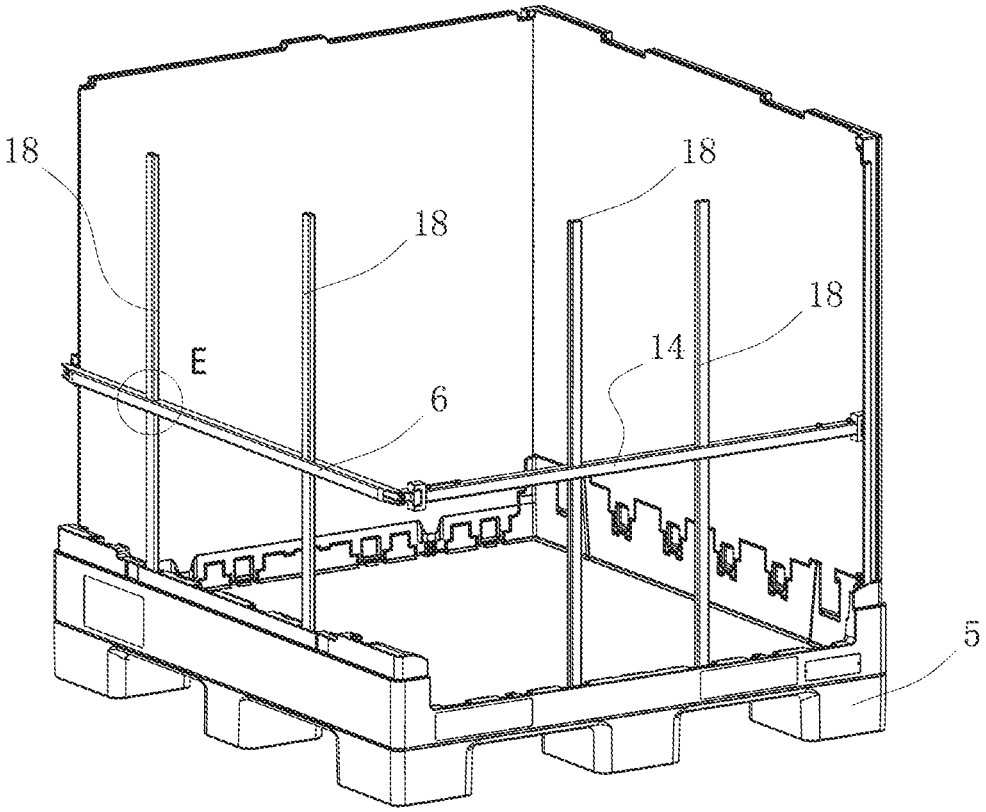
FIG. 7 is a structural schematic view of a container further provided with a vertical reinforcement member, in which part of the side panel structure is cut away to show the internal reinforcement members.
Figure 8:
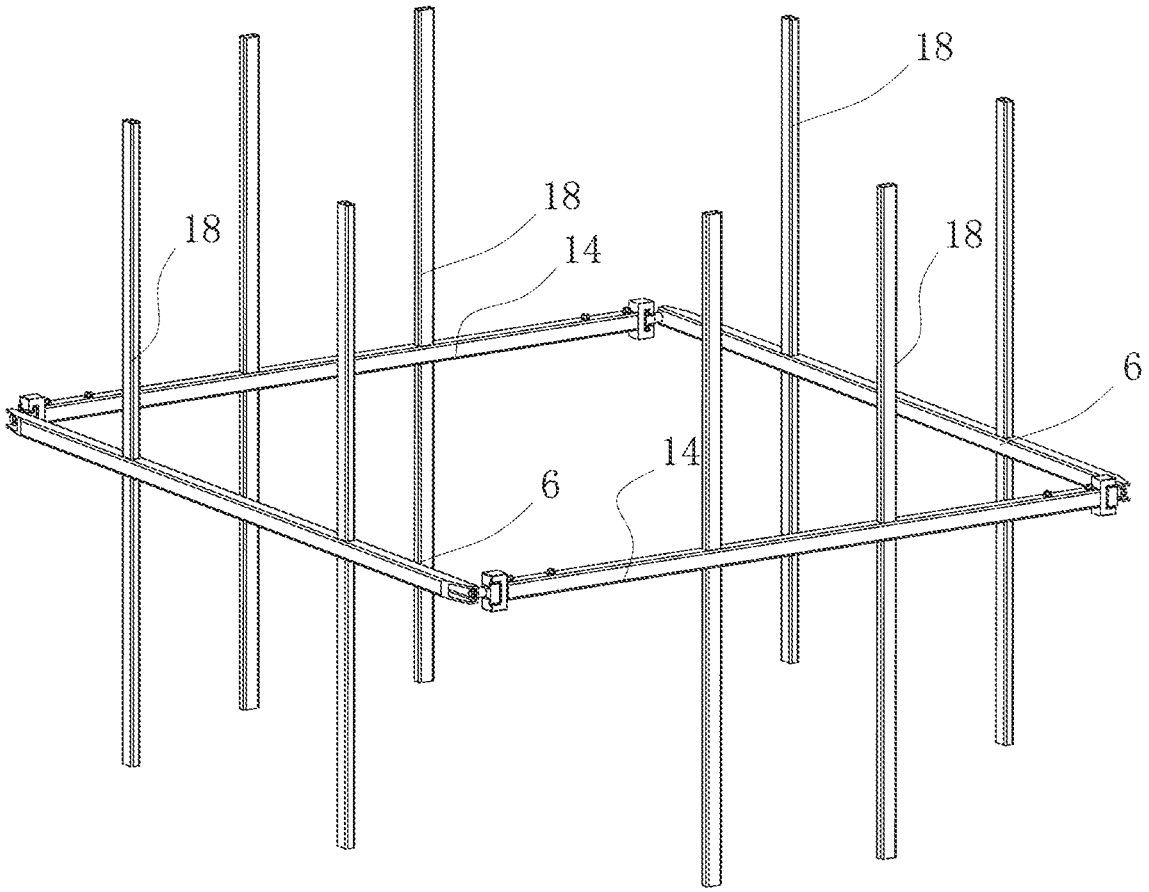
FIG. 8 is a structural schematic view of the reinforcement member, when the side panel of the container of FIG. 7 is in an upright state.

In addition to the reinforcement member 6 and the reinforcement member 14 (i.e., the first reinforcement member or the transverse reinforcement member), a second reinforcement member or vertical reinforce 18 can also be arranged in the side panels. As shown in FIGS. 7 and 8, two vertical reinforcement members 18 are attached to each of the first reinforcement members 6, 14, the respective reinforcement members 18 can be connected correspondingly to the reinforcement members 6 and 14 by welding. One end of the reinforcement member 18 extends to the top end of the side panel, that is, to the portion of the top surface of the side panel near the side panel. The other end of the reinforcement member 18 extends to the bottom end of the side panel. FIG. 8 shows a network of reinforcement members provided with first reinforcement members 6, 14 and second reinforcement members 18. Through the reinforcement members network, the side panels can be effectively reinforced, which can avoid the defect where the side plates turn white, and even bulge, deform and fail when the container bears a heavy load. This is because the first reinforcement member and the second reinforcement member that are mutually connected to each other cause the force of the side panels acting on the first reinforcement member to be dispersed, reducing stress concentration. Further, that the both ends of the second reinforcement member respectively extend to the upper and lower ends of the side panel also reduce the reaction force of the end of the second reinforcement member acting on the side panel, which further reduces the probability of whitening or even bulge deformation of the side panel.

Figure 9:
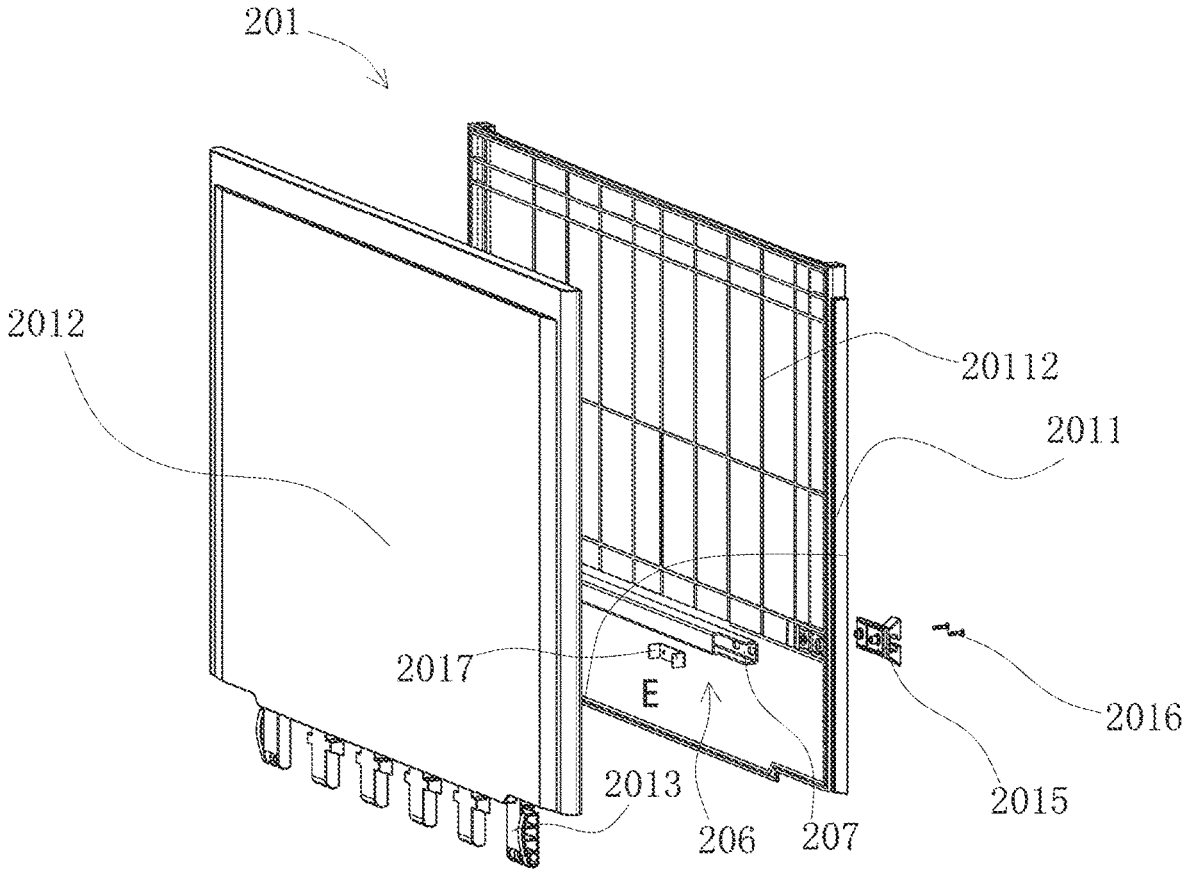
FIG. 9 is an exploded schematic view of one of the side panels of the container according to the second embodiment of the present invention.
Figure 10:
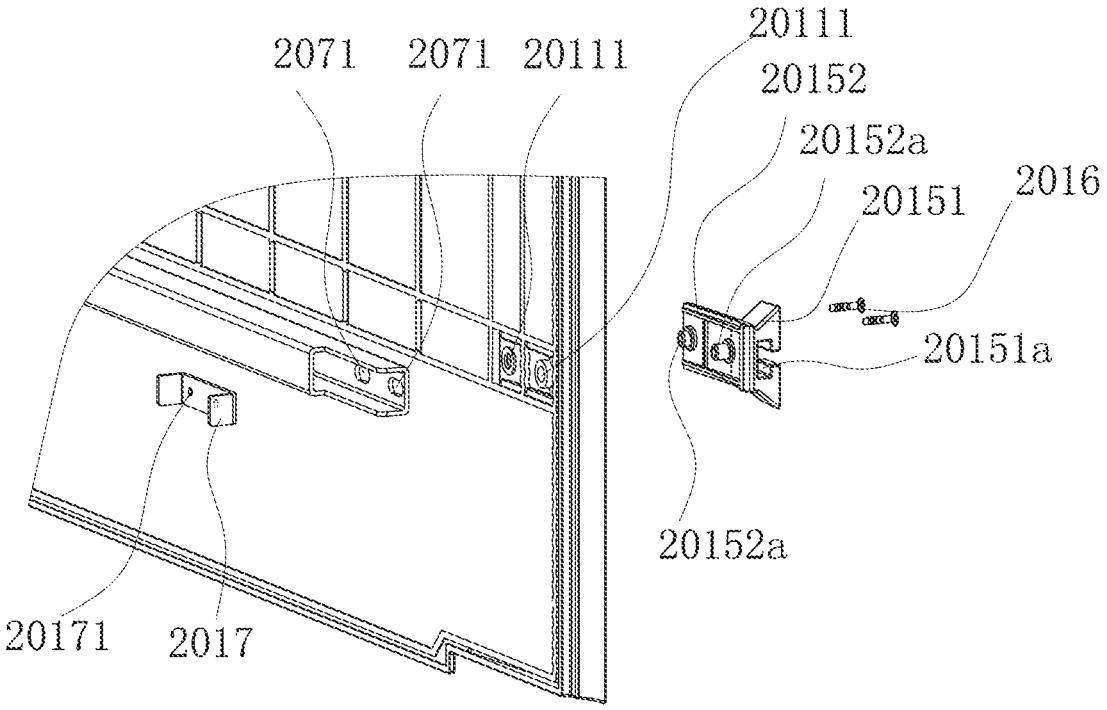
FIG. 10 is an enlarged view of the portion E of FIG. 9.
Figure 11:
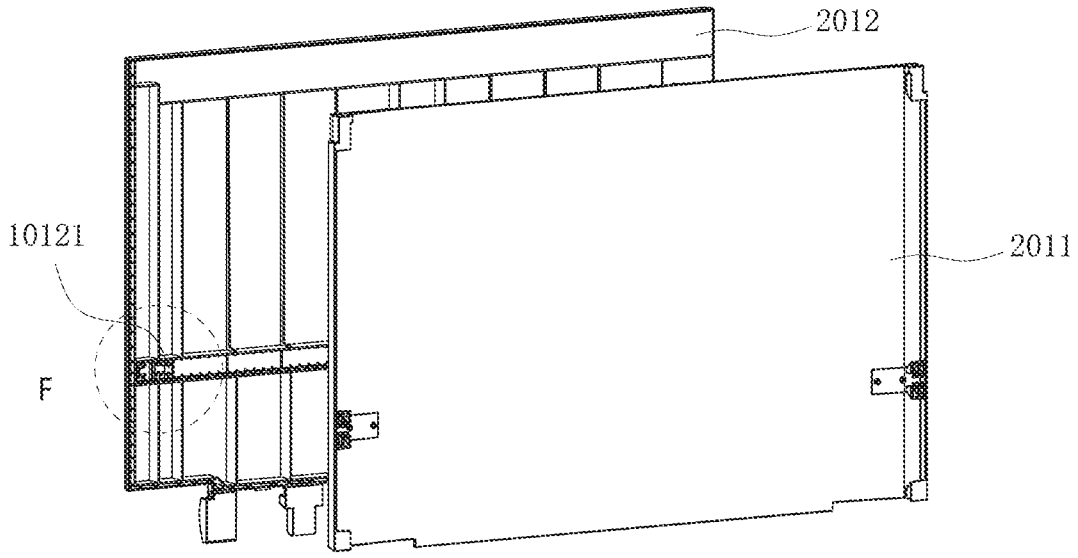
FIG. 11 is a structural schematic view of the outer panel and the inner panel of the side panels of the container of FIG. 9, showing the mutually facing sides of the outer panel and the inner panel.
Figure 12:
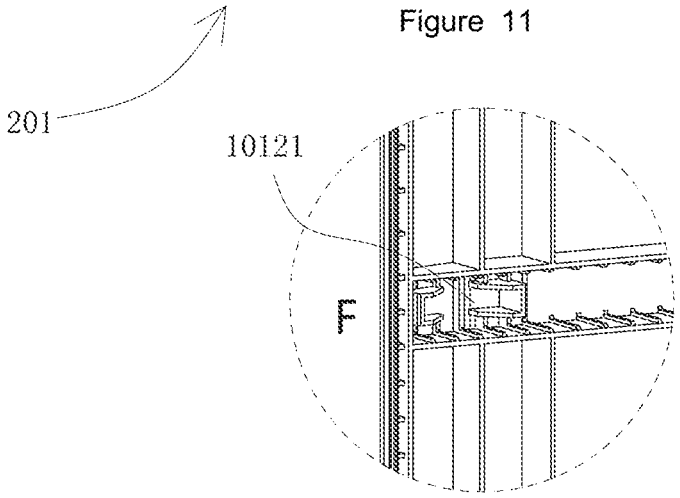
FIG. 12 is an enlarged view of a portion F of FIG. 11.
Figure 13:
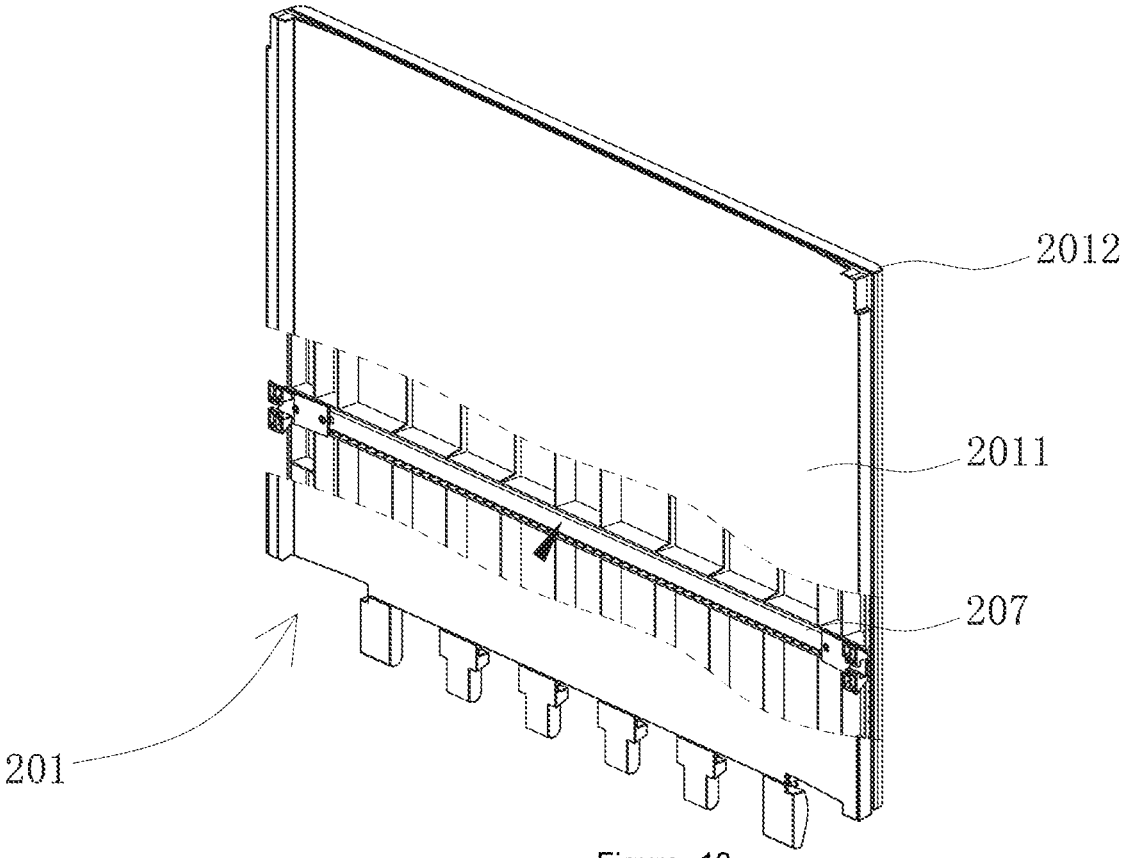
FIG. 13 is a perspective view of the side panel of FIG. 9, partially cut away to show the internal reinforcement member.
Figure 14:
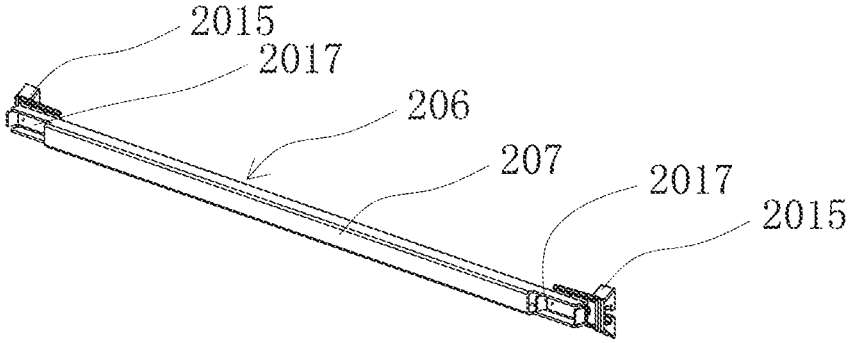
FIG. 14 is a structural perspective view of the reinforcement member of FIG. 13.

FIGS. 9-10 show schematic views of a side panel 201 and its built-in reinforcement member 206 in accordance with a second embodiment of the present invention. For convenience of description, this side panel is referred to as a long side panel 201. As shown in FIGS. 9-10, the long side panel 201 comprises an inner panel 2011 and an outer panel 2012, and the inner panel 2011 and the outer panel 2012 are welded to each other to form a long side panel 201. The hinge 2013 is provided in the lower part of the long side panel 201, specifically, the outer panel of the 2012, and the long side panel 201 is hinged to the base 5 by a hinge 2013, so that it can be foldable relative to the base 5.

A reinforcement member 206 is disposed between the inner panel 2011 and the outer panel 2012 of the long side panel 201, the reinforcement member 206 is installed on the inner panel 2011. The side of the inner panel 2011 facing the outer panel is provided with a rib 20112 to enhance the strength of the long side panel 201. A connecting hole 20111 for connecting the reinforcement member 206 is also disposed on the inner panel 2011. The reinforcement member 206 comprises a steel pipe 207 and dovetail pieces 2015 at both ends of the steel pipe 207, and the dovetail pieces 2015 are connected to both ends of the steel pipe 207 by rivets 2016 and U-shaped fixing pieces 2017. Specifically, the cross section of the steel pipe 207 is square or rectangular. Part of the side of the both ends of steel pipe 207 is cut off. The dovetail piece 2015 comprises the dovetail part 20151 and the connection part 20152, and the dovetail section 20151 is provided with a slot 20151*a*, which has a T-shaped cross section, thereby to cooperate with a T-shaped wedge, which will be further described below. The connection part 20152 is provided with a hole 20152*a*. The steel pipe 207 is provided with a hole 2071 on the portion which is partially cut.

Preferably, the hole 2071 is a long hole. The U-shaped fixing piece 2017 is provided with a hole 20171. Further, as shown in FIGS. 11-14, the outer panel 2012 of the long side panel 201 is provided with a limit pit 10121 at a position corresponding to the U-shaped fixing piece 2017 fixed on the inner panel 2011, and the limit pit 10121 is used for fixing the U-shaped fixing piece 2017 after the long side panel 201 is assembled.

When assembled, the rivet 2016 passes through the hole 20171, the hole 20152*a* and the connecting hole 20111 on the inner panel 2011 in sequence, thereby fixing the steel pipe 207, the dovetail piece 2015 and the U-shaped fixing piece 2017 together to form the inner panel 2011 of the long side panel. Then, the outer panel 2012 is welded to the inner panel 2011, wherein the reinforcement member 206 is fixed therein. After the welding is completed, the U-shaped fixing piece 2017 is fixed by the limit pit 10121 on the outer panel 2012. After the above assembly is completed, when the side panels are subjected to bending stress, the reaction force of both ends of the steel pipe 207 is transmitted to the dovetail piece 2015, and at the same time, the long hole 2071 of the steel pipe 207 allows the steel pipe 207 to be effectively connected to the dovetail member 2015 when the size of the long side panel 201 shrink or expand as temperature changes.

FIGS. 15-19 are structural schematic views of the side panel 302 adjacent to the side panel 201 shown in FIGS. 9-10, for the convenience of the description, the side panel 302 is referred to as a short side panel 302. As shown, the short side panel 302 comprises an inner panel 3021 and an outer panel 3022, and the inner panel 3021 and the outer panel 3022 are welded to each other to form a short side panel 302. A hinge 3010 is provided at a lower portion of the short side panel 302, and the short side panel 302 is hinged to the base 5 by a hinge 3010, so as to be foldable relative to the base 5.

A reinforcement member 3014 is also disposed between the inner panel 3021 and the outer panel 3022 of the short side panel 302, and the reinforcement member 3014 is received in the limiting slot 30211 of the inner panel 3021. The side of the inner panel 3021 facing the outer panel 3022 is provided with ribs to enhance the strength of the short side panel 302. The reinforcement member 3014 comprises a steel pipe 30141, a T-shaped wedge 30142 at both ends of the steel pipe 30141 and a U-shaped fixing piece 30143, wherein the T-shaped wedge 30142 is connected to both ends of the steel pipe 30141 by rivets 30144. After the assembly of the reinforcement member 3014 is completed, the reinforcement member 3014 is placed in the limiting slot 30211 of the inner panel 3021, between the outer panel 3022 and the inner panel 3021 of the short side panel 302, and the outer panel 3022 is welded to the inner panel 3021, the reinforcement member 3014 being fixed therein.

Figure 15:
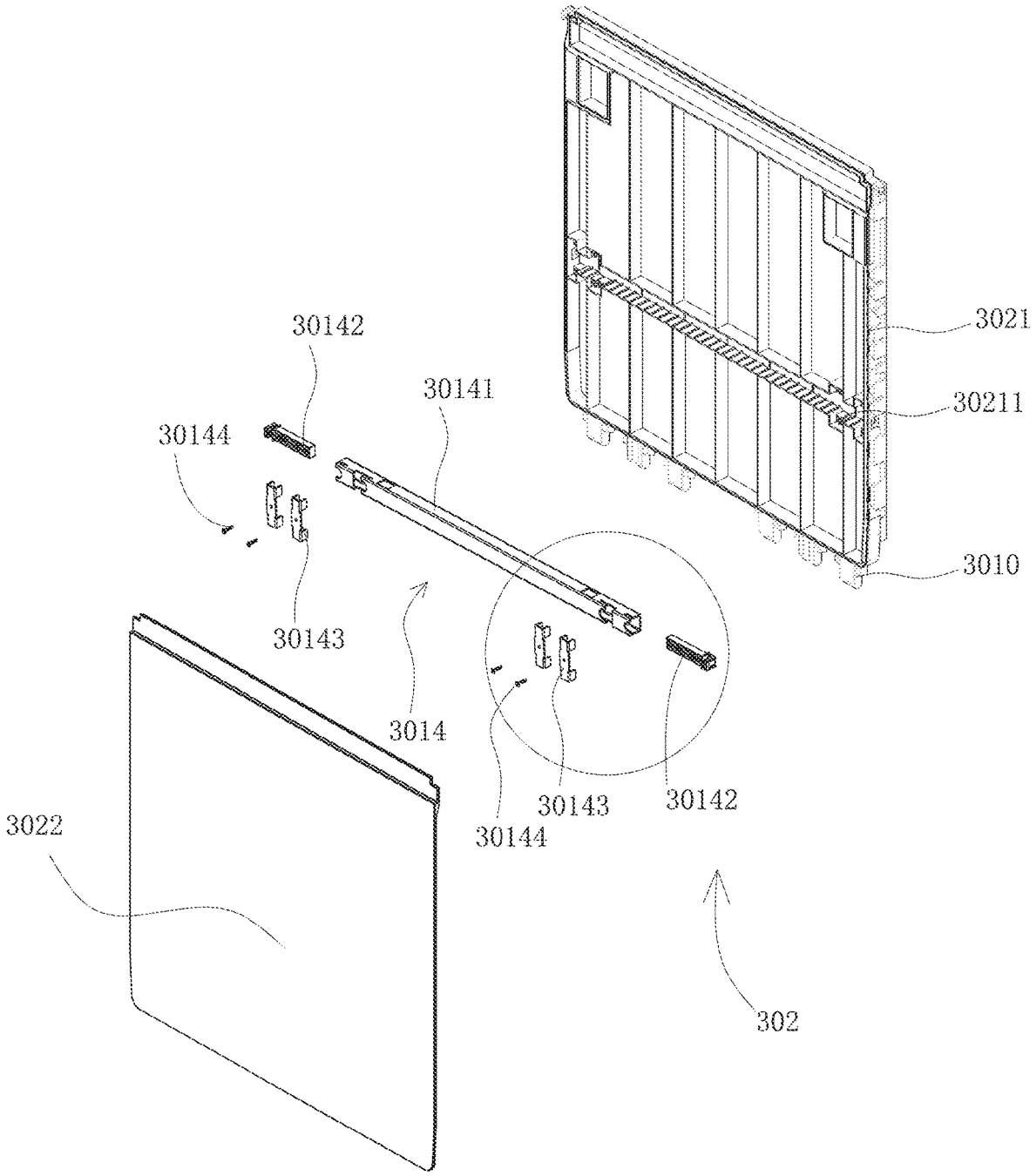
FIG. 15 is an exploded perspective view of the side panel adjacent to the side panel of FIG. 9.
Figure 15A:
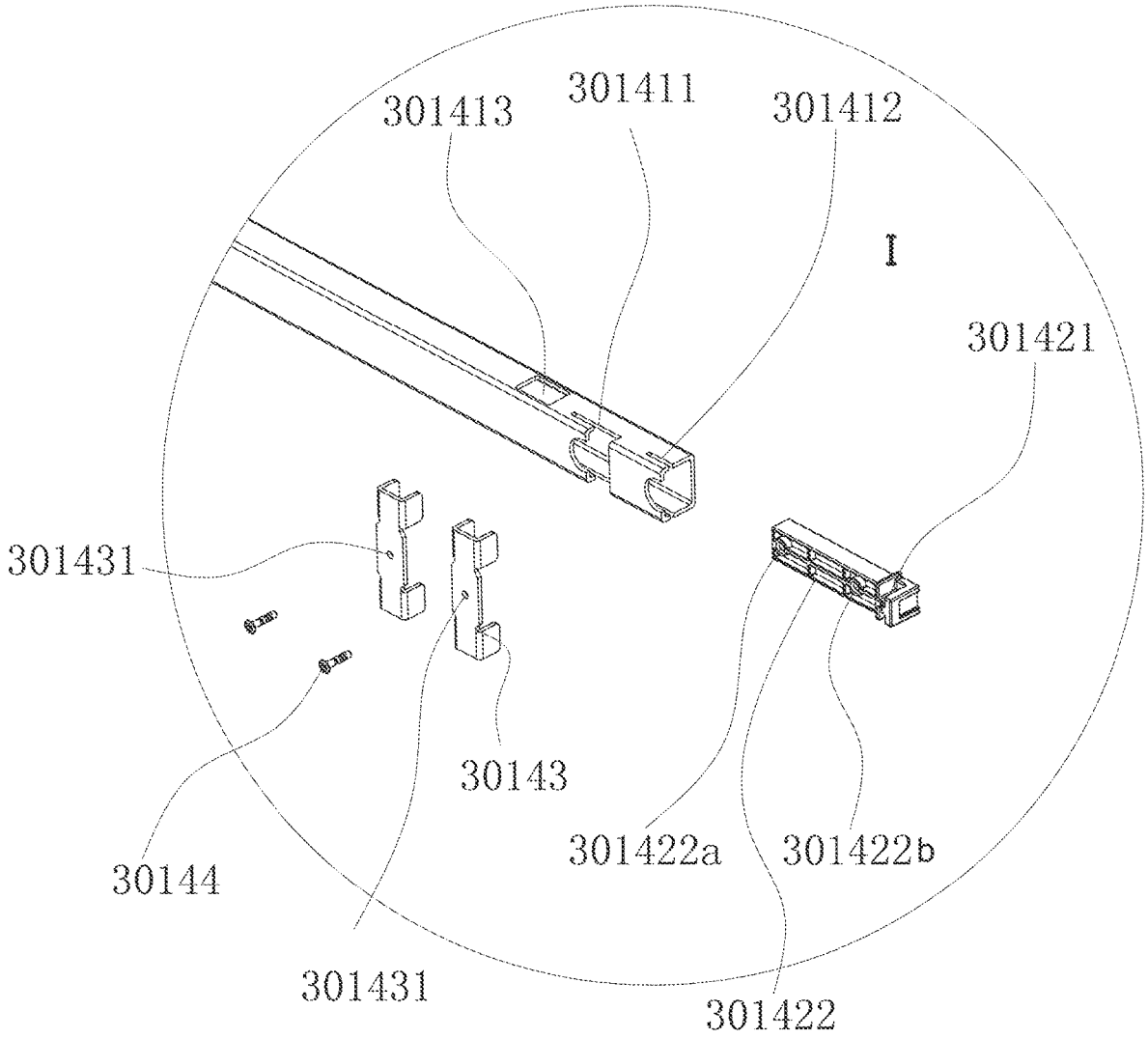
FIG. 15A is an enlarged view of the portion I of FIG. 15.

Specifically, as shown in FIG. 15A, the steel pipe 30141 is provided with long neck 301411 and 301412, respectively used to receive the U-shaped fixing pieces 30143 during assembly. The steel pipe 30141 is also provided with a mounting hole 301413, which is used for the vertical reinforcement member inserted therein and connected to the reinforcement member 3014, such as by means of welding. The T-shaped wedge 30142 is provided with a T-shaped interlocking portion 301421 and a connection portion 301422. The T-shaped interlocking portion 301421 is provided with a T-shaped interlocking structure, which is used for cooperation with the slot of the reinforcement members on the adjacent side panel, so as to realize the occlusion between the two reinforcement members. The connection portion 301422 is used to be inserted into the steel pipe 30141 during assembly. The connection portion 301422 is provided with a connection hole 301422*a*.

Figure 16:
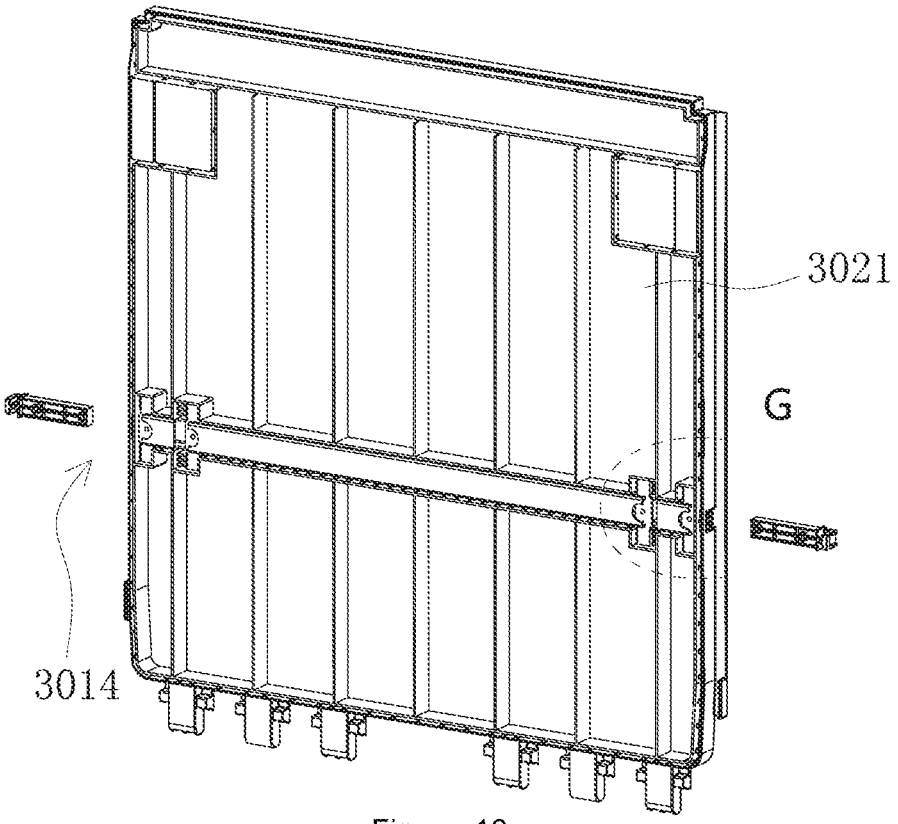
FIG. 16 is a structural schematic view of the outer panel and the reinforcement member of the side panel of FIG. 15.
Figure 17:
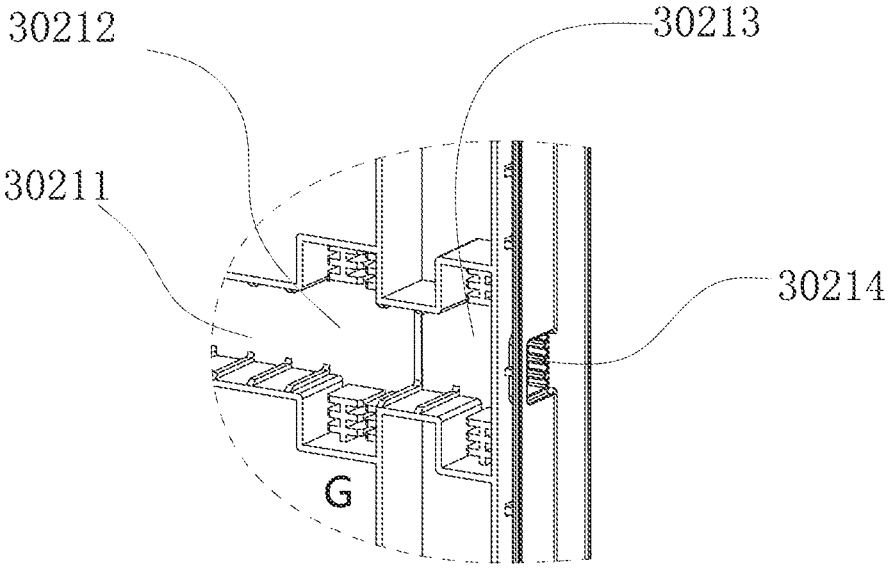
FIG. 17 is an enlarged view of the portion G of FIG. 16, wherein the reinforcement member is removed to show the corresponding outer panel structure of side panel.
Figure 18:
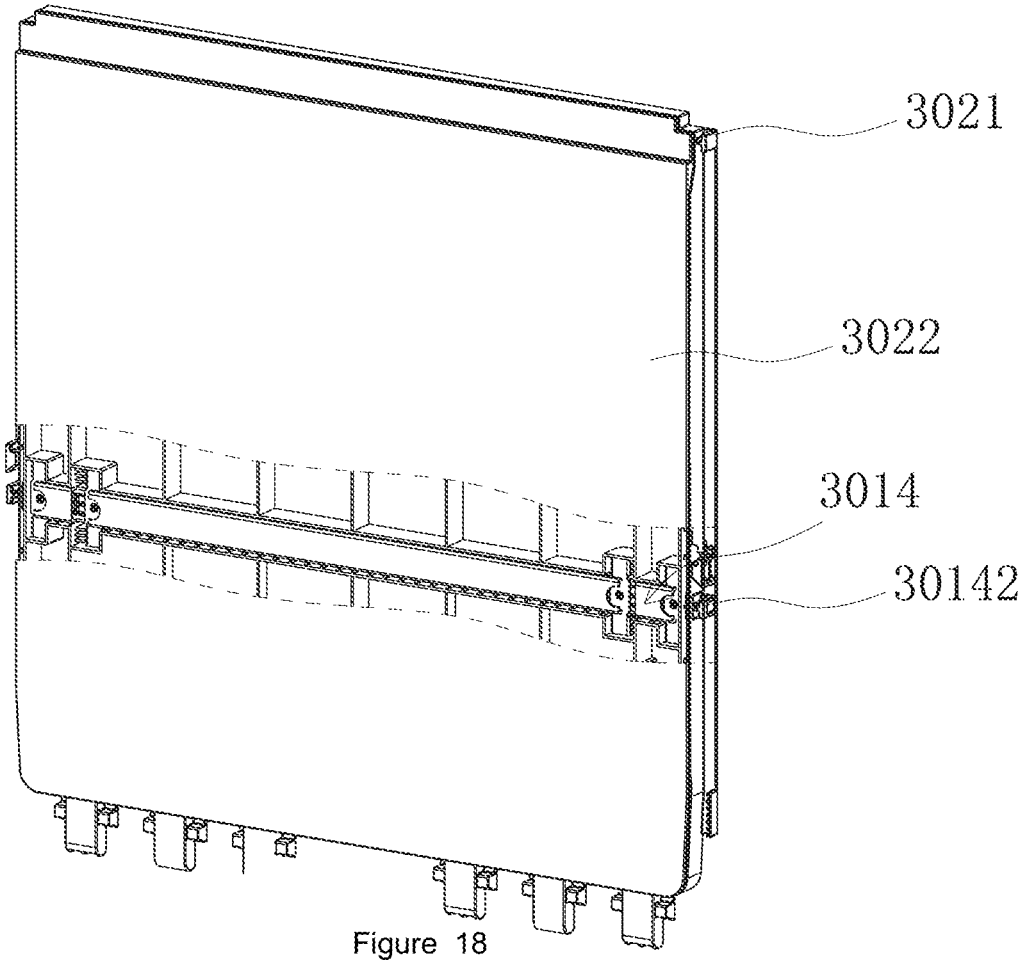
FIG. 18 is a structural schematic view of the side panel of FIG. 15, partially cut away to show the reinforcement member.
Figure 19:
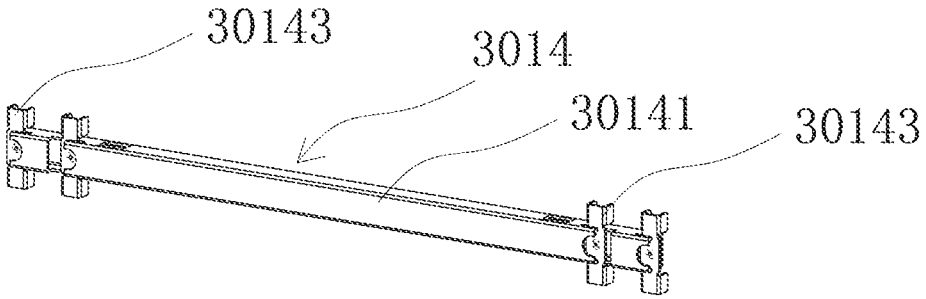
FIG. 19 is a structural schematic view of the reinforcement member of FIG. 18.
Figure 20:
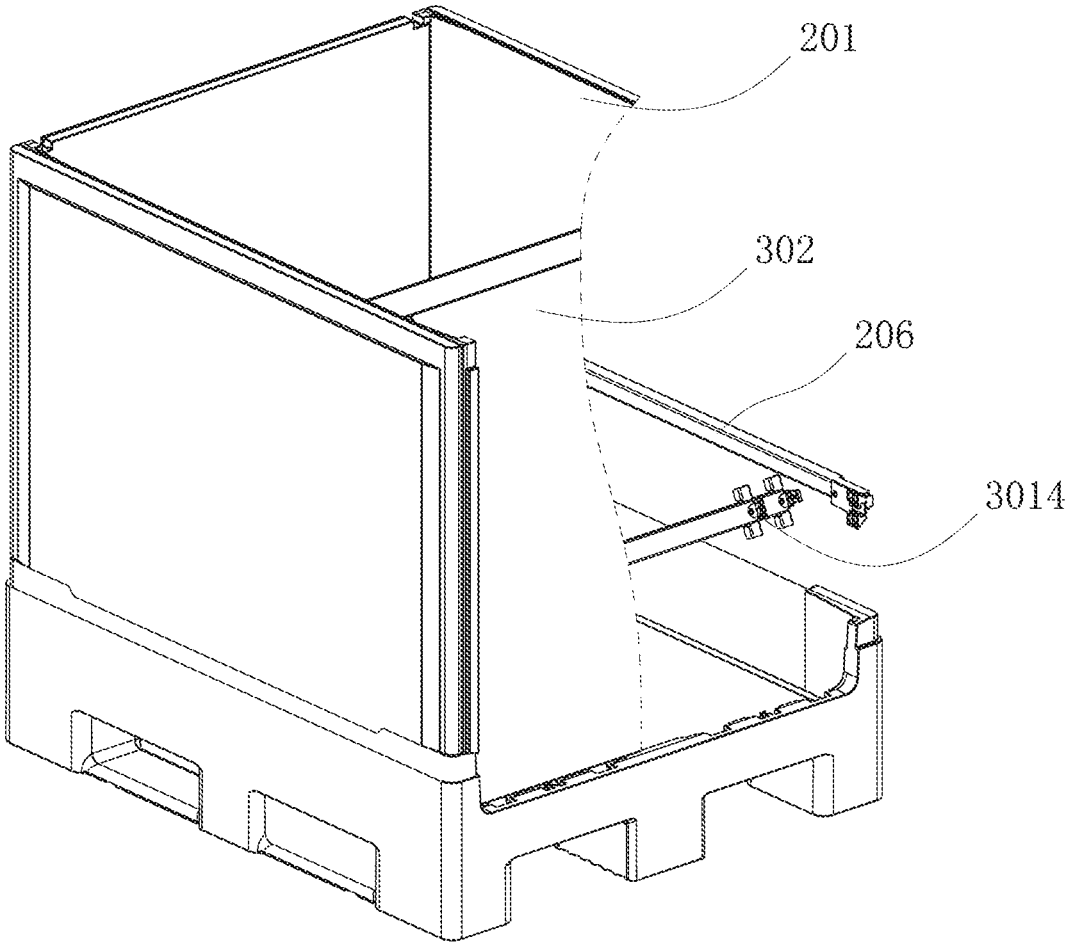
FIG. 20 is a structural schematic view of the container employing the side panels of FIGS. 9 and 15, wherein half of the side panels are pushed down and part of the side panel structure is removed to show the reinforcement members.

As shown in FIG. 16-17, the inner panel 3021 of the short side panel 302 is provided with limiting slots 30212 and 30213, respectively for holding two U-shaped fixing pieces 30143, and a through-hole 30214 for the T-shaped wedge passing through.

When assembled, two U-shaped fixing pieces 30143 are respectively installed in the neck 301411 and 301412 and are respectively placed in the limiting slots 30212 and 30213 on the inner panel 3021 of the short side panel 302. Then, the T-shaped wedge 30142 is inserted into the steel pipe 30141 through the through-hole 30214. Then, one rivet sequentially passes through the hole 301431 on the U-shaped fixing piece 30143 and the hole 301422*a* on the connection portion 301422, the other rivet sequentially passes through the hole 301431 on the U-shaped fixing piece 30143 and the hole 301422*a* on the connecting portion 301422, thus two U-shaped fixing pieces 30143, a T-shaped wedge 30142 and a steel pipe 30141 are fixedly connected together. Finally, the inner panel 3021 provided with the reinforcement member 3014 are welded along with the outer panel 3022. After installation, the neck on the steel pipe 30141 allows the U-shaped fixing pieces and the T-shaped wedge to move relative to the steel pipe for a predetermined distance.

Figure 21:
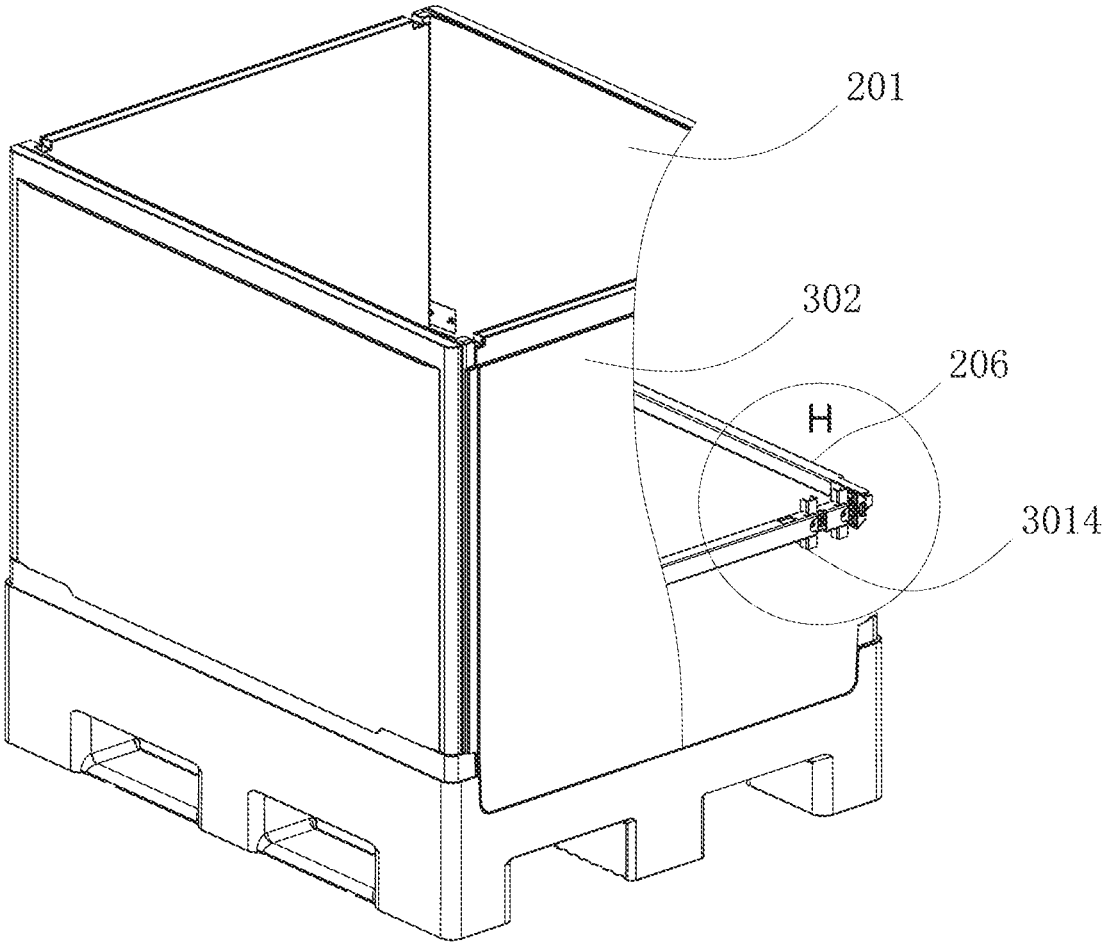
FIG. 21 is a structural schematic view of the container employing the side panels of FIGS. 9 and 15, wherein the side panels are in an upright position and part of the side panel structure is removed to show the reinforcement members.
Figure 21A:
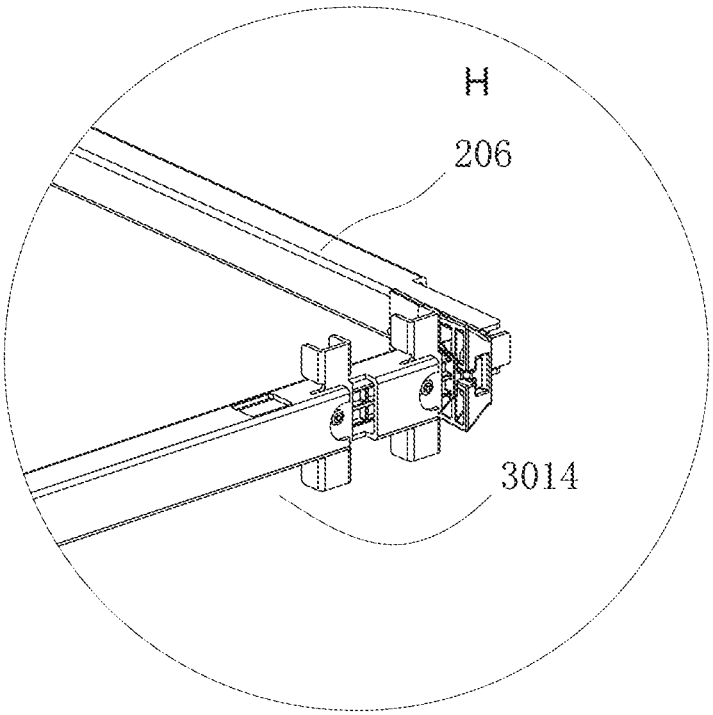
FIG. 21A is an enlarged view of the portion H of FIG. 21.
Figure 22:
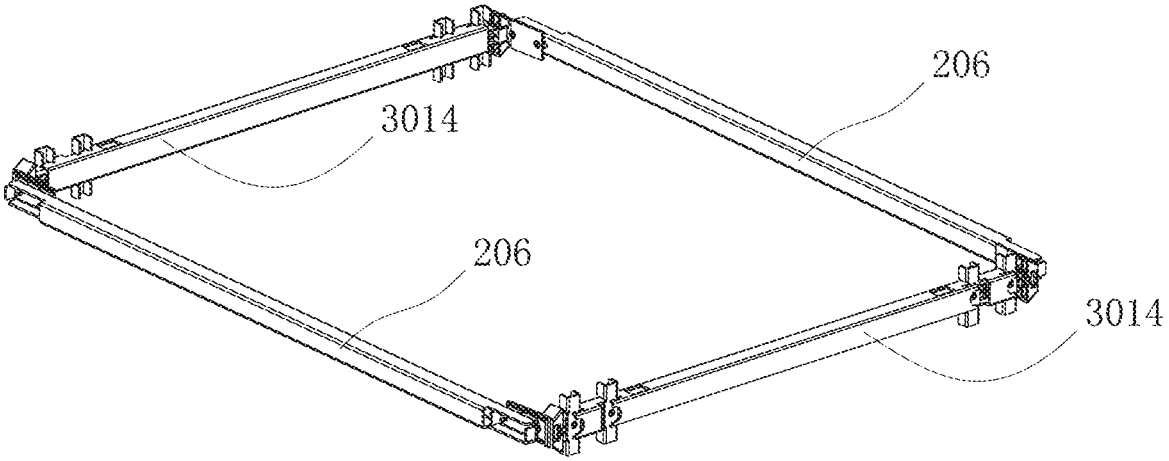
FIG. 22 is a structural schematic view of the reinforcement member of the container of FIG. 21.

After the long side panel 201 and the short side panel 302 are assembled and welded, they are installed into the base 5 through the hinges, so that both the short side panel and the long side panel can be folded by pushing or erected relative to the base. When the side panels are folded (here, the short side panel 302 is taken as an example), as shown in FIG. 4, interlocking of the dovetail piece 2015 and the T-shaped wedge 30142 is separated apart, at this time, the reinforcement members of the short side panel 302 and the long side panel 201 are separated. When the side panels are in an upright state, as shown in FIG. 21-22, the dovetail 3015 and the T-shaped wedge 30142 are snapped together, that is, the T-shaped wedge 30142 is inserted into the slot 20151*a* of the dovetail 2015, so that the reinforcement member of the short side panel 302 and the long side panel 201 are connected together. In this way, the corresponding reinforcement members of the two pairs of side panels are connected to each other to form a ring-shaped integral body as shown in FIG. 22.

It should be understood that in the above embodiment, the reinforcement member 206 may also be placed in the short side panel 302, and accordingly, the reinforcement member 3014 may be placed in the long side panel 201. Alternately, the structure of the reinforcement members of the long side panel 201 and the short side panel 302 may also be substantially the same, for example, in this case, the reinforcement members of the short side panel and the long side panel are both provided with a dovetail piece at one end and a T-shaped wedge at the other end. The reinforcement member 206 and the reinforcement member 3014 may be referred to as a first type of reinforcement member or first reinforcement member or transverse reinforce.

Similar to the embodiment illustrated in FIGS. 2-8, in the embodiment illustrated in FIGS. 9-22, in addition to the reinforcement member 206 and the reinforcement member 3014 (i.e., the first reinforcement member or the transverse reinforcement member), a second reinforcement member or vertical reinforcement member can be arranged, not detailed here.

After the reinforcement member of the embodiment shown in FIGS. 9-22 is assembled, when the side panels are subjected to bending stress, the reaction forces at both ends of the steel pipe are transmitted to the T-shaped wedges, at the same time, the neck 301411 and 301421 of the steel pipe allow the reinforcement member of the one side panels to be effectively connected to the reinforcement member of the other side panels when the size of the long side panel 201 shrink or expand as temperature. The reinforcement members which mutually connect to each other cause the forces acting on the reinforcement members of the side panels to be dispersed, reducing stress concentration and reducing the probability of whitening or even bulge deformation of the side panels.

In each of the above embodiments, a steel pipe is used as the reinforcement member, it should be understood that any suitable material such as aluminum alloy or carbon fiber may also be used and formed into a tubular or rod shape as a reinforcement member. In addition, the cross-sectional shape of the steel pipe may be any suitable shape such as a square or a rectangle.

In addition, in the above embodiments, the T-shaped wedge and the dovetail with the T-shaped groove are used to realize the connection or the interlocking between the reinforcement members of the two adjacent side panels. It should be understood that any suitable interlocking structure known in the art can also be employed, so that when the side panels are folded, the corresponding reinforcement members of the adjacent side panels are separated, while when the side panels are upright, the corresponding reinforcement members of the adjacent side panels can be connected or interlocked.

In addition, in each of the above embodiments, the foldable container is provided with only one layer of the first reinforcement member, that is, one first reinforcement member is disposed in each of the side panels. It should be understood that each side panel may be provided with two, three or more first reinforcement members, so that the foldable container may have multi-layer first reinforcement members in the height direction.

It should also be noted that, in the above embodiments, the reinforcement member is first placed between the inner panel and the outer panel of the side panel, and then the inner panel and the outer panel are welded to each other. It should be understood that the side panels may also be made in one piece and then the reinforcement members are installed into the interior of the side panels.

The preferred embodiment of the present invention has been described in detail above, however, it will be understood that various modifications and changes may be made to the present invention by those skilled in the art after reading the above teachings of the present invention, these equivalent forms also fall within the scope defined by the claims appended hereto.

The invention claimed is:

1. A foldable container, comprising:

a base and two pairs of side panels, each of the side panels being coupled to the base in a foldable manner relative to the base, wherein each of the side panels is provided with at least one first reinforcement member, and when the side panels are in an upright state the first reinforcement members of first and second adjacent ones of the side panels are mutually connected, wherein an end of the first reinforcement member of the first adjacent one of the side panels is provided with a first connection structure, and a corresponding end of the first reinforcement member of the second adjacent one of the side panels is provided with a second connection structure, and when the first and second adjacent ones of the side panels are in the upright state, the first connection structure and the second connection structure are connected to each other, and wherein the first connection structure is provided with a T-shaped interlocking structure and is fixed to the first reinforcement member by a fastener, and the second connection structure is provided with a T-shaped groove, the T-shaped groove the T-shaped interlocking structure is detachably engaged.

2. The foldable container according to claim 1, wherein when the side panels are in the upright state, the first reinforcement members of the two pairs of side panels are connected to each other to form a ring-shaped integral body.

3. The foldable container according to claim 1, wherein the first reinforcement member is disposed at a middle portion of the side panel.

4. The foldable container according to claim 1, wherein the first reinforcement member is parallel to the base.

5. The foldable container according to claim 1, wherein the first reinforcement member forms an angle with the base.

6. The foldable container according to claim 1, wherein each side panel comprises an inner panel and an outer panel which are fixedly coupled to each other, and the first reinforcement member is disposed between the inner panel and the outer panel.

7. The foldable container according to claim 6, wherein the side panels are formed by welding the inner panel and the outer panel together.

8. The foldable container according to claim 6, wherein a side of the inner panel and/or the outer panel on which the first reinforcement member is placed is provided with ribs.

9. The foldable container according to claim 1, wherein the first connection structure and the first reinforcement member are separate members and are joined together by fasteners; and/or the second connection structure and the second reinforcement member are separate members and are joined together by fasteners.

10. The foldable container according to claim 9, wherein the fastener is a screw or rivet.

11. The foldable container according to claim 9, wherein the first connection structure and the second connection structure are exposed on a side of the side panel facing the adjacent side panel.

12. The foldable container according to claim 1, wherein the first connection structure is provided with a first interlocking structure, and the second connection structure is provided with a second interlocking structure, wherein when the side panels are in the upright stat, the first interlocking structure and the second interlocking structure are interlocked with each other.

13. The foldable container according to claim 1, wherein the second connection structure is provided with an interlocking portion and a connection portion, the interlocking portion is provided with the T-shaped groove, the connection portion is inserted into the first reinforcement member and fixed on the first reinforcement member by the fastener.

14. The foldable container according to claim 1, wherein the first connection structure and/or the second connection structure are movably coupled to the first reinforcement member.

15. The foldable container according to claim 1, wherein the first two adjacent one of the side panels comprises a first inner panel and a first outer panel that are fixedly coupled to each other, the first reinforcement member in the side panel comprises a first steel pipe and a dovetail member at both ends of the first steel pipe, a first U-shaped fixing piece and fastener, wherein a long hole is provided on the end of the first steel pipe, and the dovetail member comprises a T-shaped groove and is provided with a first connecting hole, and the first U-shaped fixing piece is provided with a second connecting hole, the first inner panel is provided with a third connecting hole, and the fastener sequentially passes through the second connecting hole, the long hole, the first connecting hole and the third connecting hole and thereby fix the first reinforcement member to the first inner panel; the first outer panel is provided with a groove for receiving the U-shaped fixing piece; and the second adjacent one of the side panels comprises a second inner panel and a second outer panel that are fixedly coupled to each other, and the first reinforcement member in the side panel comprises a second steel pipe and a T-shaped wedge at both ends of the second steel pipe a second U-shaped fixing piece and fastener, wherein the second steel pipe is provided with an long neck at the end, used for receiving the second U-shaped fixing piece, the T-shaped wedge comprises a T-shaped interlocking portion and a connection portion, the connection portion is provided with a fourth connecting hole and inserted into the second steel pipe, the second U-shaped fixing piece is provided with a fifth connecting hole, and the fastener sequentially passes through the fifth connecting hole and the fourth connecting hole, so as to connect the U-shaped fixing piece and the T-shaped wedge to the second steel pipe, the inner panel is provided with a limiting groove for receiving the second steel pipe and the second U-shaped fixing piece.

16. The foldable container according to claim 1, wherein each of the side panels also comprises a second reinforcement member, and the second reinforcement member is fixedly coupled to the first reinforcement member.

17. The foldable container according to claim 16, wherein the second reinforcement member is perpendicular to the base.

18. The foldable container according to claim 1, wherein a first end of the second reinforcement member extends to a top end of the side panel, and the other a second end of the second reinforcement member extends to a bottom end of the side panel.

* * * * *